US005772084A

United States Patent [19]

Yale et al.

[11] Patent Number: 5,772,084

[45] Date of Patent: Jun. 30, 1998

[54] STORAGE TUBE FOR SPRAY CAN EXTENDER TUBES

[76] Inventors: William A. Yale, 600 W. Broadway, Ste. 2600, San Diego, Calif. 92101; Max R. Yale, 4991 Mt. Helix Dr., La Mesa, Calif. 91941

[21] Appl. No.: 640,545

[22] Filed: May 2, 1996

[51] Int. Cl.[6] ..... B65D 83/00

[52] U.S. Cl. ..... 222/402.1; 222/530; 222/538

[58] Field of Search ..... 222/402.1, 530, 222/538, 539; 239/587.1, 588

[56] References Cited

U.S. PATENT DOCUMENTS

| | | | |
|---|---|---|---|
| 1,284,822 | 11/1918 | Tumey | 222/538 |
| 4,520,951 | 6/1985 | Facey | 222/182 |
| 4,805,814 | 2/1989 | Allen, Sr. | 222/538 |
| 4,819,838 | 4/1989 | Hart, Jr. | 222/538 |
| 4,823,445 | 4/1989 | Diener | 24/326 |
| 5,143,263 | 9/1992 | Newell | 222/538 |
| 5,150,811 | 9/1992 | Kelston | 222/538 X |
| 5,178,354 | 1/1993 | Engvall | 248/316.7 |
| 5,409,145 | 4/1995 | Payne | 222/212 |
| 5,411,187 | 5/1995 | Schwab | 222/538 |
| 5,482,095 | 1/1996 | de Chollet | 141/380 |
| 5,544,783 | 8/1996 | Conigliaro | 222/538 X |
| 5,601,216 | 2/1997 | Visco | 222/538 |

FOREIGN PATENT DOCUMENTS 6-1382 11/1994 Japan .

*Primary Examiner*—Joseph Kaufman
*Attorney, Agent, or Firm*—Peter K. Hahn, Esq.

[57] ABSTRACT

An storage tube for storing extender tubes for spray cans is provided. The storage tube of the present invention includes a hollow tube having an internal constriction along its length. The constriction acts to releasably retain a storage tube inserted therein. The storage tube may be attached to spray cans and the like.

17 Claims, 2 Drawing Sheets

STORAGE TUBE FOR SPRAY CAN EXTENDER TUBES

FIELD OF THE INVENTION

This invention relates generally to storage devices and particularly to storage tubes for spray cans extender tubes.

BACKGROUND OF THE INVENTION

Spray cans are in widespread use today for storing and delivering a wide variety of materials. These materials include lubricants, paints, foam insulation and other materials. Standard spray cans include a reservoir portion in which the liquids or other materials are contained. Typically the reservoir portion is maintained at an increased pressure as compared to the exterior environment through the use of a variety of propellants. The stored material is released from the reservoir through the use of a manually operated valve connected to a spray nozzle. These spray nozzles can be configured to provide either a narrow or a diffuse stream of material. Generally, a particular nozzle can only be utilized for either a stream or a diffuse spray. On the other hand, in some situations it is desirable for the material to be released in both configurations depending on the needs of the user.

For these situations, many manufacturers utilize a nozzle which provides a generally diffuse spray. This nozzle also contains a recess into which an extender tube can be inserted. This extender tube provides for a more focused or localized stream of material. Because the extender tube is removable, the operator can easily change the spray pattern to accommodate his or her needs.

One problem associated with the removable extender tube is that many times the spray can and the extender tube become separated and/or the extender tube is lost. In this situation, the versatility of the nozzle configurations is reduced and in some cases, for example, foam insulation, the product becomes unusable and the can and the material contained therein must be discarded. In light of the foregoing, there is a need for a means to store an extender tube for a spray can which maintains the extender tube in a close relationship with the spray can. One means by which this is accomplished is through the use of a rubber band placed around the spray can. While this is sufficient for some purposes, it still allows significant transverse movement of the extender tube relative to the spray can which may allow the extender tube to become separated from the spray can. Additionally, in some situations i.e. manufacturing, packing or shipping, the rubber bands may become broken and thus no longer function for their intended purpose.

Accordingly, it is an object of the present invention to provide an improved storage means for extender tubes for spray cans and like devices. It is another object of the present invention to provide a storage means which can be fixedly attached to the spray can or like device. It is still further an object of the present invention to provide a storage means which releasably retains the extender tube. Still further, it is an object of the present invention to provide a storage device which, when the extender tube is contained within the storage device, does not allow movement of the extender tube relative to the spray can or like device. It is yet another object of the present invention to provide a storage means for extender tubes which is economical to manufacture yet durable and rugged in normal use.

SUMMARY OF THE INVENTION

In accordance with the present invention, an improved device for storing an extender tube is provided. Generally stated, the device consists of a storage tube which is attachable to spray cans and the like. Additionally, a means is included in the storage tube which retains an extender tube once inserted.

More specifically, the storage tube is a generally cylindrical tube having a hollowed out center portion. Included in the hollowed out center portion is a neck portion or constriction which releasably retains the extender tube within the hollowed out portion of the storage tube.

The constriction has an internal diameter which is smaller than the external diameter of the extender tube. Because the storage tube is made of a deformable material like plastic or vinyl, the extender tube is able to expand the constriction sufficiently enough to allow the tip of the extender tube to pass the constriction. On the other hand the pressure fit between the storage tube and the extender tube is sufficient to maintain the extender tube within the storage tube.

The storage tube is open at one end and closed at the other. The surface of the open end is inclined at an angle between 30 and 60 degrees relative to the longitudinal axis of the storage tube.

The outer surface of the storage tube can include a roughened portion or a flattened portion. The flatten portion can be of assistance if the storage tube is to be attached to the spray can or like device through the use of adhesives. On the other hand, the roughened surface assists in maintaining contact between a strip of adhesive strapping tape if such a strip is to be utilized to maintain the storage tube in contact with the spray can or like device.

Other objects, advantages and capabilities of the present invention will be more apparent as the description proceeds.

DETAILED DESCRIPTION OF THE PREFERRED EMBODIMENTS

Figure 1:
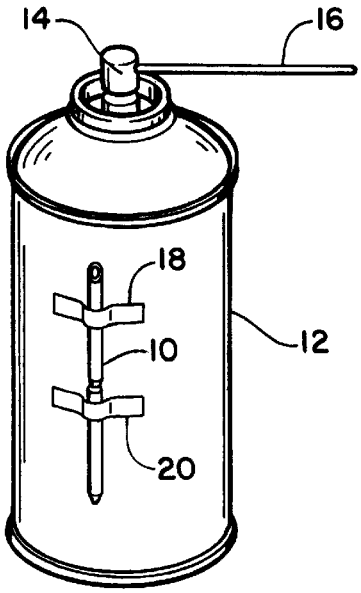
FIG. 1 is a perspective view of a spray can having an extender tube inserted in the nozzle and a storage tube of the present invention attached to the can.

Referring initially to FIG. 1, the storage tube 10 of the present invention is shown installed on a spray can 12. Spray can 12 includes a nozzle 14 and an extender tube 16. Storage tube 10 is shown attached to the spray can through the use of adhesive tape strips 18 and 20. In this configuration, those of ordinary skill in the art can see that extender tube 16 can be removed from nozzle 14 and inserted to storage tube 10.

In this manner, extender tube 16 can be maintained in a close spacial relationship to spray can 12.

Figure 2:
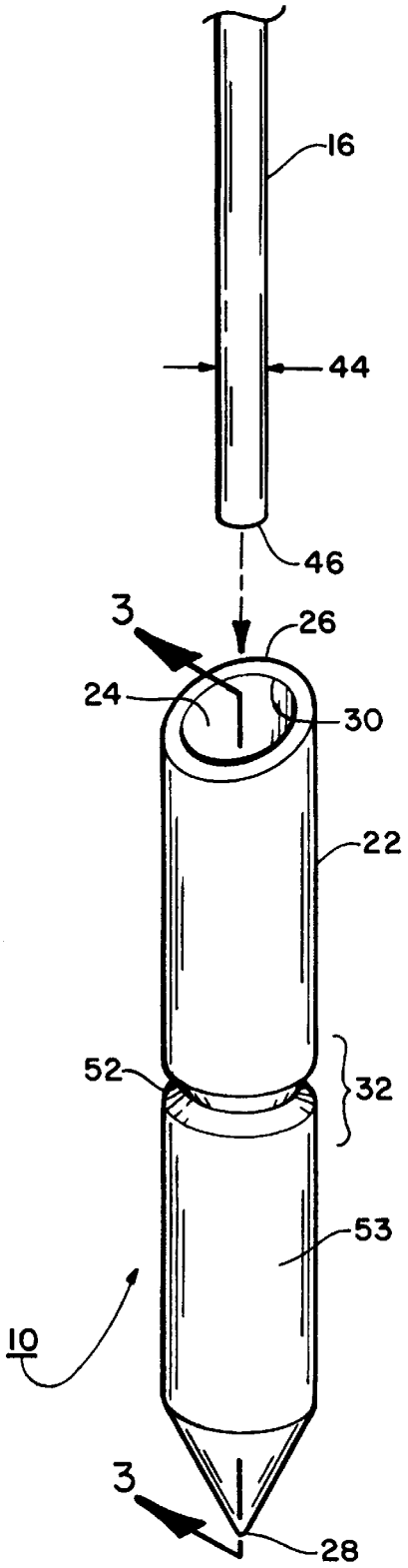
FIG. 2 is a perspective view of the storage tube of the present invention showing the extended tube oriented for insertion into the storage tube.

Referring now to FIG. 2, the storage tube of the present invention is shown and generally designated 10. The extender tube 16 is shown oriented in the position required for insertion into storage tube 10.

Figure 3:
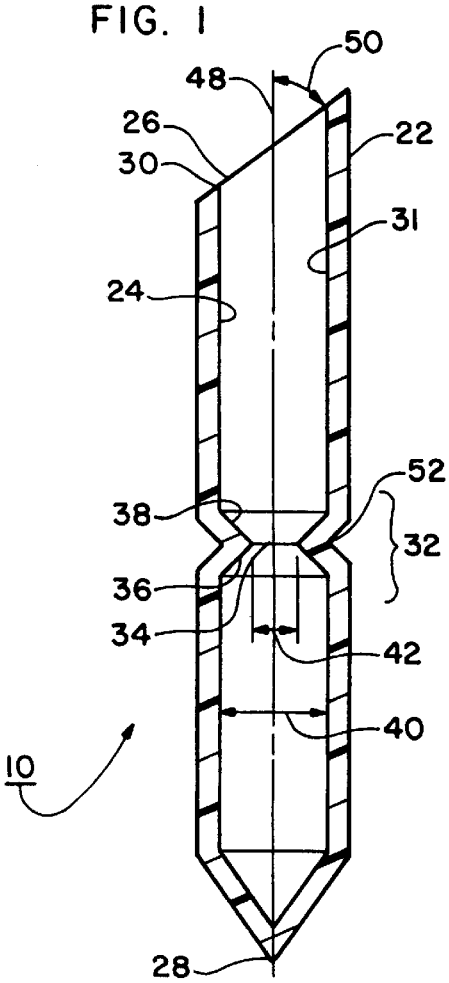
FIG. 3 is a cross-sectional view of the storage tube of the present invention.

Referring now to FIGS. 2 and 3, the exterior and interior characteristics of the storage tube of the present invention are shown. Storage tube 10 includes an outer surface 22 and an inside surface 24. Additionally, storage tube 10 includes a first end 26 and a second end 28. In this embodiment of the present invention, first end 26 includes an opening 30 and second end 28 is closed. Inside surface 24 defines a longitudinal bore 31 having at least one opening at opening 30.

Between the first end 26 and the second end 28, is a neck portion 32. Neck portion 32 includes a constriction 34 in longitudinal bore 31 which is preferably in the nature of a ridge 36. Ridge 36 includes an inclined portion 38 to facilitate insertion of the extender tube 16 through the constriction. Incline portion 38 facilitates insertion of the extender tube 16 through the constriction 34 by gradually decreasing the inside diameter of the storage tube from diameter 40 in the portion of the storage tube between the first end 26 and the inclined portion 38 to diameter 42 of the narrowest point of the constriction 34.

Storage tube 10 is preferably made of a flexible and deformable material such as resilient plastic or vinyl. Importantly, as those of ordinary skill in the art will appreciate, the storage tube 10 should be made of a material which is not adversely affected by the materials passing through the extender tube. While Storage tube 10 is shown to be generally cylindrical having generally circular internal and external cross-sections, the interior and exterior cross-sections could be of any shape, for example hexagonal or square, without departing from the scope of the present invention. Storage tube 10 can be made of standard stock tubing, be extruded or be manufactured by other methods known in the art without departing from the present invention. Preferably, storage tube 10 will have a length that is slightly less than the length of the extender tube 16. In this manner, once extender tube 16 is inserted into storage tube 10, a portion of extender tube 16 will remain exposed giving the user sufficient length of extender tube 16 to grab, thereby allowing extender tube 16 to be removed from storage tube 10.

As those skilled in the art will appreciate, diameter 40 is greater than diameter 42. Additionally, outside diameter 44 of extender tube 16 is greater than diameter 42 but less than diameter 40. In this manner, extender tube 16 can easily be inserted into storage tube 10. When tip 46 of extender tube 16 contacts the inclined portion 38 of the storage tube 10, the flexibility and deformability of storage tube 10 allows the extender tube 16 to gradually deform the neck portion 32 of the storage tube such that extender tube 16 can pass through the neck portion 32 of storage tube 10. While constriction 34 is shown in FIG. 3 to be a circumferential ridge 36 those skilled in the art will appreciate that alternative constrictions are equally possible without departing from the spirit and scope of the present invention. For example, internally facing nubs will accomplish the same purpose, namely, to reduce the minimum inside diameter of the storage tube 10 such that the minimum inside diameter at the constriction is less than the outside diameter of the extender tube.

Once the extender tube 16 is inserted into storage tube 10 and passes through the neck portion 32, the pressure fit resulting between the constriction 34 and the outer surface of extender tube 16 will maintain extender tube 16 snugly within storage tube 10.

Storage tube 10 includes a longitudinal axis 48. End 26 of storage tube 10 is preferably flat and inclined at an angle 50 with regard to the longitudinal axis 48 of storage tube 10. Preferably angle 50 will be in the range of 30 to 60 degrees. Some instances it may be preferable that this angle is as much as 90 degrees relative to the longitudinal axis, although by decreasing the angle of the end 26 relative to the longitudinal axis 48, the cross-sectional area of opening 30 is increased which further facilitates insertion of end 46 of extender tube 16 into storage tube 10.

For most situations, end 28 of storage tube 10 is preferably closed. In some situations, for example those situations where extender tube 16 may retain liquids which should not be retained within the storage tube 10, those skilled in the art will appreciate that an opening at end 28 may be desirable. In the particular embodiment shown in FIG. 3, end 28 has been crimped such that the side wall of storage tube 10 forms a point.

The neck portion 32 of storage tube 10 is preferably formed by permanently deforming the side wall of storage tube 10 as is shown in FIG. 3. The requisite deformation can be accomplished by means known to those of ordinary skill in the art. One such means is to use thermoplastic material for tube 10. The thermoplastic material is then heated, deformed by applying localized pressure and allowed to cool as deformed. Other means are likewise possible. Once the side walls are permanently deformed inwardly, then the ridge 36 with its accompanying inclined portion 38 are formed on the interior storage tube 10. Likewise, a recessed circumferential groove 52 is formed on the outer surface 22 of storage tube 10.

Figure 4A:
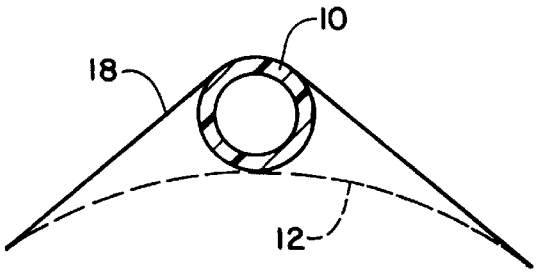
FIG. 4*a* and 4*b* are cross-sectional views of the storage tube of the present invention shown taped to a spray can.
Figure 4B:
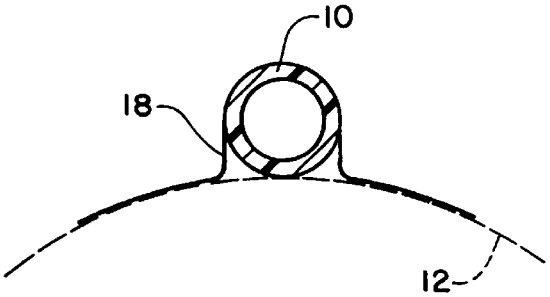

Storage tube 10 can be attached to a spray can or like container. Referring now to FIG. 4*a*, one manner in which storage tube 10 may be attached to a spray can is shown. In this particular configuration, storage tube 10 is placed immediately adjacent spray can 12 (shown in phantom). Wrapped over the outside surface of storage tube 10 and contacting spray can 12 on either side of storage tube 10 is at least one strip of adhesive tape 18. Alternatively, as is shown in FIG. 4*b*, the adhesive tape 18 can be attached to tube 10 around a greater portion of its circumference to further improve adhesion between tube 10 and tape 18. As those skilled in the art will appreciate, use of more than one strip of adhesive tape will enhance the rigidity of the connection between the storage tube 10 and spray can 12. See for example a configuration utilizing two strips of adhesive tape as is shown in FIG. 1. Additionally, as is shown in FIG. 2, outer surface 22 may include a roughened portion 53 to increase the adhesion between the tape and the tube.

Figure 5:
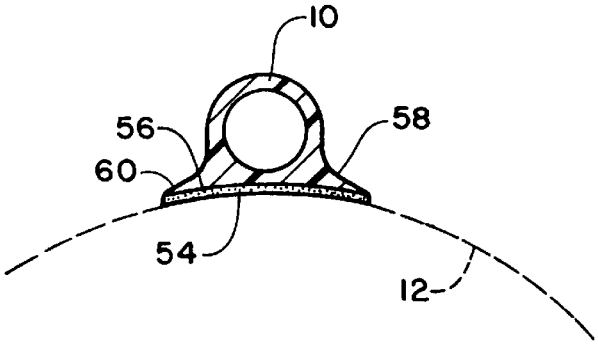
FIG. 5 is a cross-sectional view showing the storage tube of the present invention fixed to a spray can with an adhesive.

Alternatively, as is shown in FIG. 5, a storage tube may be directly adhered to a spray can. Specifically, as is shown is FIG. 5, storage tube 10 is fixedly attached to spray can 12 (shown in phantom) by means of an adhesive 54. In order to further enhance the connection between spray can 12 and storage tube 10, storage tube 10 includes as substantially planar section 56 running along at least a portion of its length. Additionally, as is shown in FIG. 5, the planar surface 56 can include extensions 58 and 60 to further increase the surface area contacting spray can 12.

Figure 6:
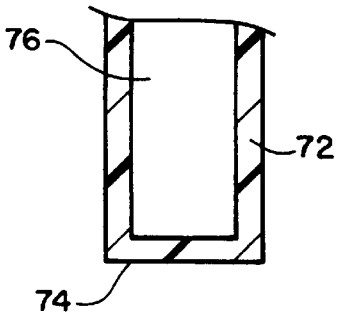
FIG. 6 is a partial cross-section showing an alternative embodiment for the closed end of the storage tube of the present invention.

As those skilled in the art will appreciate, in those situations where it would be desirable to have second end 28 of storage tube 10 be closed, other embodiments for end 28 are possible without departing from the spirit and scope of the present invention. One such alternate embodiment is shown in FIG. 6. In this embodiment, storage tube 72 is formed with an integral base portion 74. In this manner the second end of storage tube 72 is closed leaving a longitudinal bore or recess 76 which extends the entire length of the storage tube to its open end.

Figure 7:
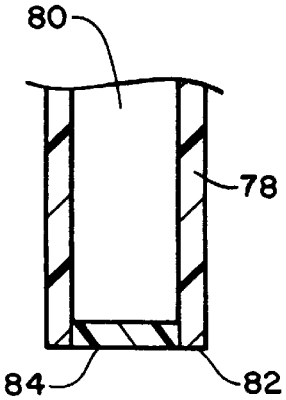
FIG. 7 is a partial cross-sectional view of an alternative embodiment for the closed end of the storage tube of the present invention.

Yet another embodiment of the second end of the storage tube of the present invention is shown in FIG. 7. As is shown in this configuration, storage tube 78 has a longitudinal bore 80 which extends the entire length of the storage tube to its open end. As those skilled in the art will appreciate, plug 84 may be retained in end 82 by a pressure fit, use of an adhesive or by bonding, welding or other means known to those skilled in the art.

Figure 8:
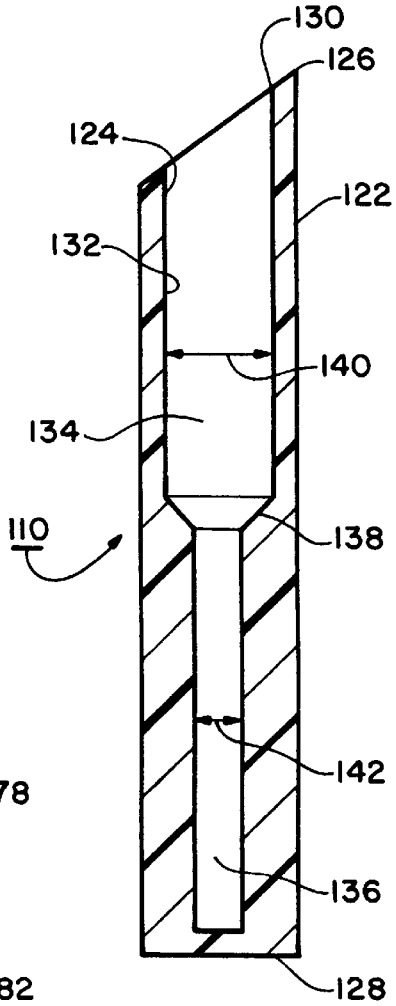
FIG. 8 is a cross-sectional view of an alternative embodiment of the storage tube of the present invention.

Yet another embodiment of the storage tube of the present invention is shown in FIG. 8 and is generally designated 110. Storage tube 110 includes an outside surface 122 and an inside surface 124. Storage tube 110 includes a first end 126 and a second end 128. First end 126 includes opening 130. Second end 128 is made from preferably an integral piece of the storage tube 110 and is closed. As those skilled in the art will appreciate, for particular situation, second end 128 may include an opening or may include a plug configuration similar to that shown in FIG. 7. Storage tube 110 is formed such that inside surface 124 defines a longitudinal bore 132 having a wide section 134 with an inside diameter 140. Additionally, longitudinal bore 132 includes a narrow portion 136 having an inside diameter 142. Inside diameter 142 is less than inside diameter 140 and is separated via inclined portion 138. The inclined portion 138 and narrow portion 136 are the functional equivalent of the constriction 34 shown in FIG. 3. In operation, a extender tube 16 can be inserted into wide portion 134 until it contacts the incline portion 138. As extender tube 16 is advanced further into longitudinal bore 132, the flexible material comprising storage tube 110 allows the constriction along the inclined portion 138 and the narrowed portion 136 to expand to accommodate the outside diameter of the extender tube 16. Again, the pressure fit between the extender tube and the narrowed portion 136 securely retain extender tube 16 within the longitudinal bore 132.

While the invention has been described with reference to certain preferred embodiments, as will be apparent to those skilled in the art, certain changes and modifications can be made without departing from the spirit and scope of the invention as defined by the following claims.

What is claimed is:

1. A device for storing an extender tube, said device comprising:

a generally cylindrical tube having a first end, a second end, an outside surface and an inside surface, said inside surface defining a longitudinal bore in said tube, said bore including an opening at said first end; and a constriction in said longitudinal bore between said first end and said second end for cooperatively engaging the extender tube when said extender tube is positioned in said bore and wherein the cylindrical tube includes a longitudinal axis and the first end includes an first end surface, said first end surface defining a first end plane, said first end plane being oriented at an angle with respect to said longitudinal axis, said angle being in the range of 30 to 60 degrees.

2. The device as recited in claim 1 wherein said constriction comprises a circumferential ridge along said inside surface.

3. The device as recited in claim 2 wherein said ridge is located in the middle third of the bore.

4. The device as recited in claim 1 wherein said longitudinal bore does not extend the entire length of the tube.

5. The device as recited in claim 1 wherein said tube is crimped adjacent said second end to close said second end of said tube.

6. The device as recited in claim 1 wherein at least a portion of said outer surface is roughened.

7. The device as recited in claim 1 wherein said outer surface includes a circumferential groove between the first end and the second end.

8. The device as recited in claim 1 wherein said outer surface includes a substantially planar portion between said first end and said second end.

9. The device as claimed in claim 1 wherein said constriction has a first diameter and said extender has a second diameter, said first diameter being less than said second diameter, and further wherein said tube is made of a deformable material to allow said tube and said constriction to deform to accommodate insertion of said extender tube through said constriction.

10. A device for storing an extender tube, said device comprising:

a generally cylindrical tube having a first end, a second end, an outside surface and an inside surface, said inside surface defining a longitudinal bore in said tube, said bore including an opening at said first end; and a constriction in said longitudinal bore between said first end and said second end for cooperatively engaging the extender tube when said extender tube is positioned in said bore and wherein a plug is included in said longitudinal bore to close said second end of said tube.

11. A device for storing an extender tube, said device comprising:

a generally cylindrical tube having a first end, a second end, an outside surface and an inside surface, said inside surface defining a longitudinal recess in said tube, said recess including an opening at said first end; and a constriction in said longitudinal recess between said first end and said second end for cooperatively engaging the extender tube when said extender tube is positioned in said bore, said constriction having a first diameter and said extender having a second diameter, said first diameter being less than said second diameter, said tube being made of a deformable material to allow said tube and said constriction to deform to accommodate insertion of said extender tube through said constriction and wherein the tube includes a longitudinal axis and the first end includes an first end surface, said first end surface defining a first end plane, said first end plane being oriented at an angle with respect to said longitudinal axis, said angle being in the range of 30 to 60 degrees.

12. The device as recited in claim 11 wherein said constriction comprises a circumferential ridge along said inside surface.

13. The device as recited in claim 12 wherein said ridge is located in the middle third of the recess.

14. The device as recited in claim 13 wherein at least a portion of said outer surface is roughened.

15. A combination of a spray can, an extender tube for said spray can and a storage tube for said extender tube, said storage tube comprising:

a generally cylindrical tube attached to said spray can by an adhesive, said tube having a first end, a second end, an outside surface and an inside surface, said inside surface defining a longitudinal recess in said tube, said recess including an opening at said first end; and a constriction in said longitudinal recess between said first end and said second end for cooperatively engaging the extender tube when said extender tube is positioned in said bore, said constriction having a first diameter and said extender having a second diameter, said first diameter being less than said second diameter, said tube being made of a deformable material to allow said tube and said constriction to deform to accommodate insertion of said extender tube through said constriction.

16. The device as recited in claim 15 wherein at least a portion of said outer surface is roughened.

17. A combination of a spray can, an extender tube for said spray can and a storage tube for said extender tube, said storage tube comprising:

a generally cylindrical tube attached to said spray can by at least one strip of adhesive tape, said tube having a first end, a second end, an outside surface and an inside surface, said inside surface defining a longitudinal recess in said tube, said recess including an opening at said first end; and a constriction in said longitudinal recess between said first end and said second end for cooperatively engaging the extender tube when said extender tube is positioned in said bore, said constriction having a first diameter and said extender having a second diameter, said first diameter being less than said second diameter, said tube being made of a deformable material to allow said tube and said constriction to deform to accommodate insertion of said extender tube through said constriction.

* * * * *